US007740494B2

(12) United States Patent
Lin et al.

(10) Patent No.: US 7,740,494 B2
(45) Date of Patent: Jun. 22, 2010

(54) DATA STORAGE APPARATUS

(75) Inventors: Wei Hung Lin, Hsinchu (TW); Yu Ting Tseng, Hsinchu (TW)

(73) Assignee: Phison Electronics Corp., Hsinchu (TW)

( * ) Notice: Subject to any disclaimer, the term of this patent is extended or adjusted under 35 U.S.C. 154(b) by 55 days.

(21) Appl. No.: 11/896,182

(22) Filed: Aug. 30, 2007

(65) Prior Publication Data

US 2009/0061696 A1 Mar. 5, 2009

(51) Int. Cl.
*H01R 13/44* (2006.01)

(52) U.S. Cl. ..... 439/131

(58) Field of Classification Search ..... 439/131
See application file for complete search history.

(56) References Cited

U.S. PATENT DOCUMENTS 6,923,666 B1 * 8/2005 Liao ..... 439/172
7,466,556 B2 * 12/2008 Hiew et al. ..... 439/131
2008/0076280 A1 * 3/2008 Chi et al. ..... 439/131

FOREIGN PATENT DOCUMENTS

CN 87 1 01609 A 10/1987

* cited by examiner

*Primary Examiner*—Tho D Ta
(74) *Attorney, Agent, or Firm*—Bacon & Thomas, PLLC

(57) ABSTRACT

The present invention discloses a data storage apparatus, including a memory module, a USB connector connected with the memory module, a housing for accommodating the memory module, a movable carriage for holding the memory module and the USB connector, and a rotary driving mechanism for transmitting a rotary motion into a linear motion for driving the USB connector.

14 Claims, 7 Drawing Sheets

DATA STORAGE APPARATUS

FIELD OF THE INVENTION

The present invention relates to a data storage apparatus with a USB connector, and more particularly, to a data storage apparatus with a movable USB connector for use with a host computer.

BACKGROUND OF THE INVENTION

Data acquisition on a host device, such as a personal computer, has seen remarkable improvements as technology evolved over the years. For example, various local peripheral devices are coupled to computer systems via a variety of recently developed technologies, including USB, IEEE1394, and other interfaces, for data transportation. Among these, the USB provides connectivity to one or more peripheral devices at significantly higher speed than traditional serial ports. Widespread adoption of the USB in industrial applications such as flash drive and thumb drive escalates data acquisition. Other than that, USB has a plug-and-play interface to search for and load an appropriate device driver for the coupled peripheral device. The plug and play feature brings great data portability, while such advantage always accompanies a certain shortcomings. Namely, connector (or plug) of the USB is rather delicate and vulnerable to damp or static electricity. Therefore, standard flash drive is usually equipped with a cap or cover to protect the USB connector from the risk of exposure.

Please refer to FIG. 1, which is a schematic diagram of a standard flash drive with a USB plug in prior art. Normally there is a cap 11 to protect a USB connector 12. After the cap 11 covering on the USB connector 12, the cap 11 is just matched with a case 13, thereby the cap 11 and the case 13 become one body collectively. The body can protect both the USB connector 12 and electrical parts (not shown in FIG. 1). During usage, the cap 11 may be taken off from the case 13 and easily lost. Once the cap 11 is lost, USB connector 12 may then be simply damaged. Hence, how to improve the disadvantage in prior art is the major discussion of the present invention.

FIG. 2 is a schematic diagram of a flash drive with a retractable USB connector for eliminating chances of losing the cap for protecting the USB connector. As illustrated in FIG. 2A and FIG. 2B, a USB connector 22 is retractable and primarily controlled by pushing a button 21. When pushing forward the button 21, as the arrow indicated in FIG. 2A, the USB connector 22 protrudes out a case 23 of the flash drive. Reversely, when pushing the button 21 toward the direction as the arrow indicated in FIG. 2B, the USB connector 22 is withdrawn back into the case 23. Besides, the case 23 is provided with a slot 231 for allowing linear movement of the button 21. The slot 231 destroys the integrity of surface of the case 23, which could have been reserved for exquisite appearance design or other purposes.

Referring to FIG. 3, it shows a prior art flash device according to U.S. Pat. No. 6,808,400. FIG. 3A shows a USB connector 33 being hidden in a case 37. The USB connector 33 connects to a PCB 35, and a top of the PCB 35 has a plurality of springs 39 for withstanding between an internal surface of a top of the case 37 and the top of PCB 35. Meanwhile, the springs 39 are elongated. Depressing and pushing a pushing button 311 of a positioning structure 31 upward makes that a buckling piece 315 is inserted into a buckling hole 373 because the pushing button 311, an extended arm 313 and the buckling piece 315 are in one body. On the other hand, pushing button 311 connects with PCB 35 so that USB connector 33 is protruded out from a USB exit 371, as shown in FIG. 3B. At the moment, the springs 39 are depressed, and slightly poking up a poking piece 317 to take buckling piece 315 off the buckling hole 373 for recovering back to the status shown as FIG. 3A via spring force.

As described, the U.S. Pat. No. 6,808,400 employs springs, a buckling piece, and a buckling hole to launch as well as position the USB connector. When the springs are depressed, the USB connector is protruded out. Otherwise, the USB connector is hidden in the case when the springs are released. Utilizing the springs might be an easy way out, while can't keep the manufacturing cost down. Besides, the performance of the springs would decrease after constant depressing and releasing back and forth. Therefore, the primary focus of the present invention is to introduce a data storage apparatus to solve the problems mentioned above. A rotary driving mechanism is adopted for controlling movement of the USB connector. Through turning the rotary driving mechanism, the USB connector is able to either protrude out or draw back into the case of the data storage apparatus. Unlike conventional storage apparatuses, the present invention not only eliminates chances of losing the cap of the conventional storage apparatus, but significantly mitigates the problems of prior arts as well.

SUMMARY OF THE INVENTION

Certain problems of previous devices have been recognized by the present invention. It has been noted that previous apparatus did not take advantage of the benefits which have been found to be possible according to the present invention. It is an object of the present invention to provide a data storage apparatus with a protection mechanism for its USB connector.

In accordance with an aspect of the present invention, a data storage apparatus includes a memory module, a USB connector connected with the memory module, a housing for accommodating the memory module, a movable carriage for holding the memory module and the USB connector, and a rotary driving mechanism for transmitting a rotary motion into a linear motion for driving the USB connector. The housing is provided with an opening for allowing the USB connector to pass through the housing.

Preferably, the movable carriage is provided with a first protrusion and a second protrusion, and is driven by the rotary driving mechanism by pressing against the first protrusion and the second protrusion, thereby driving the USB connector.

Certainly, when the rotary driving mechanism is turned in one direction and pressed against the first protrusion, the USB connector protrudes from the opening, while when the rotary driving mechanism is turned in the other direction, which is opposite to the one direction, and pressed against the second protrusion, the USB connector is withdrawn into the housing.

Preferably, the data storage apparatus further includes a positioning rack disposed in the housing for positioning the USB connector when the USB connector protrudes from the opening.

Typically, the positioning rack comprises an extending arm for clipping with the movable carriage for preventing the USB connector from moving.

Certainly, the USB connector is released when the rotary driving mechanism is turned in the other direction.

Preferably, the extending arm is flexible.

Typically, the rotary driving mechanism comprises a cam and a steering unit pivotally interconnected.

Alternatively, the data storage apparatus includes a rail for linearly guiding the movable carriage.

Alternatively, the data storage apparatus includes a groove for linearly guiding the movable carriage.

Preferably, the housing is provided with a key chain hole.

Alternatively, the housing is provided with a write-protection switch for protecting data stored in the data storage apparatus from being modified.

Typically, the data storage apparatus comprises a USB PenDrive and a USB flash drive.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF THE PREFERRED EMBODIMENTS

The present invention discloses a data storage apparatus with a protection mechanism for its USB connector. The objects and advantages of the present invention will become more readily apparent to those ordinarily skilled in the art after reviewing the following detailed description. The present invention needs not be limited to the following embodiments.

Figure 4B:
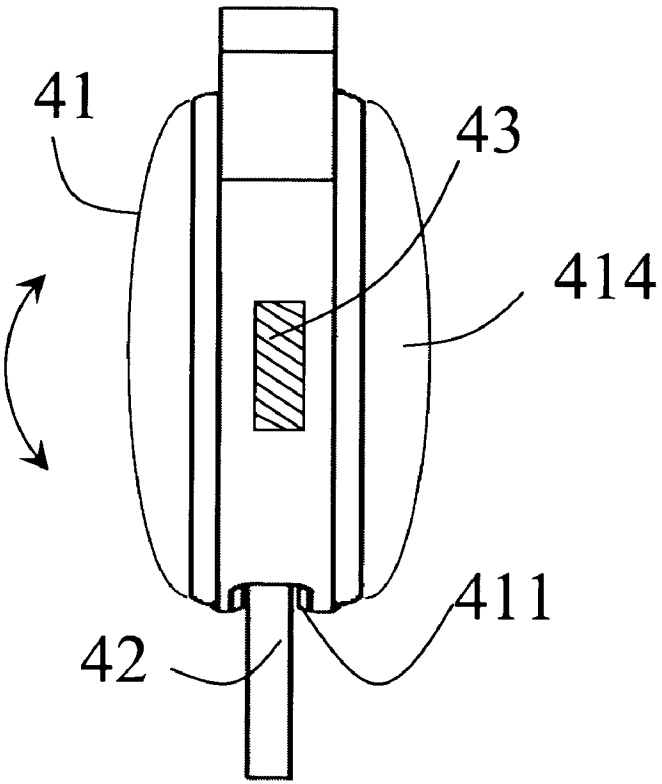
FIGS. 4A-4B are schematic diagrams of a data storage apparatus according to the present invention.
Figure 4A:
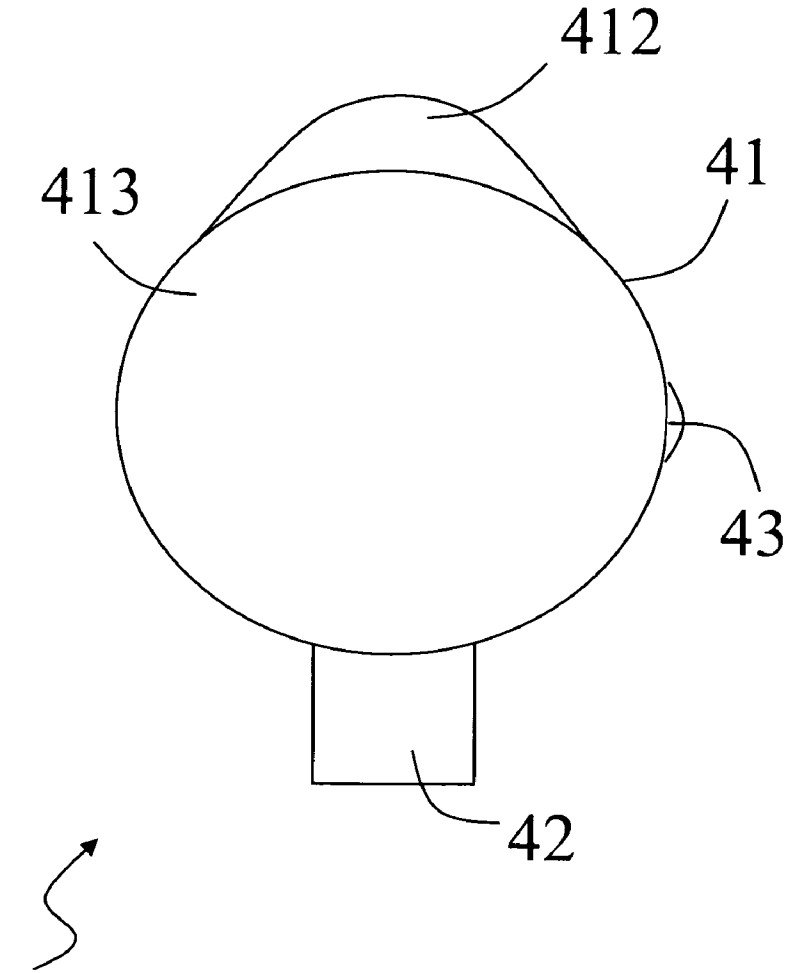

FIGS. 4A and 4B are schematic diagrams of a data storage apparatus according to the present invention. The data storage apparatus 40 includes a housing 41, a movable carriage 42 for carrying a USB connector (not shown) along with a memory module (not shown), and a rotary driving mechanism 43 for driving the movable carriage 42. The housing 41 has a sufficient capacity for accommodating the USB connector and the memory module, and is provided with an opening 411 for allowing the USB connector to exit through. Under influence of the force generated by turning the rotary driving mechanism 43, the movable carriage 42 is thrust out of the opening 411, so is the USB connector disposed thereon.

Figure 1:
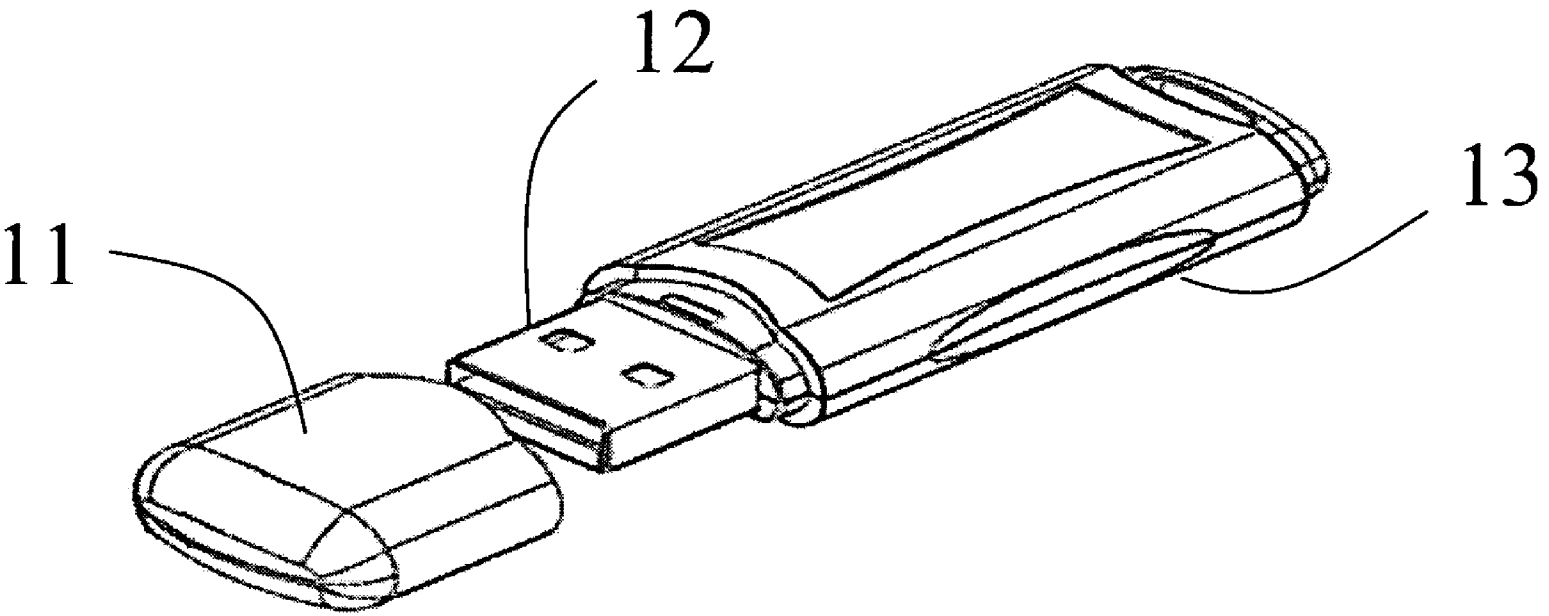
Fig. 1(Prior Art)
FIG. 1 is a schematic diagram of a standard flash drive with a USB plug according to the prior art.
Figure 2B:
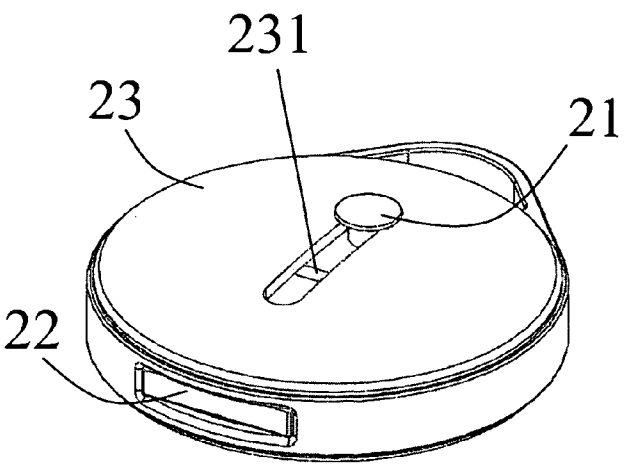
Fig. 2B (Prior Art)
FIGS. 2A-2B are schematic diagrams of a flash drive with a retractable USB connector according to the prior art.
Figure 2A:
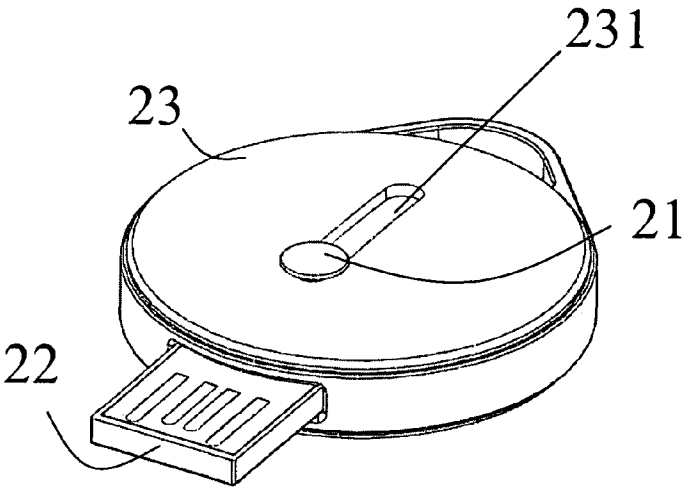
Fig. 2A (Prior Art)
Figure 3B:
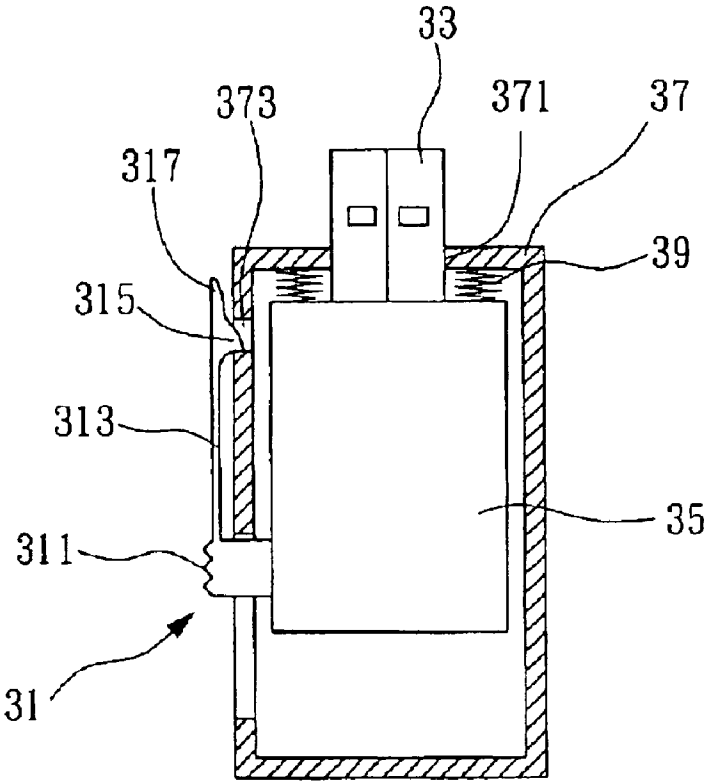
Fig. 3B (Prior Art)
FIGS. 3A-3B are schematic diagrams of another flash drive according to the prior art.
Figure 3A:
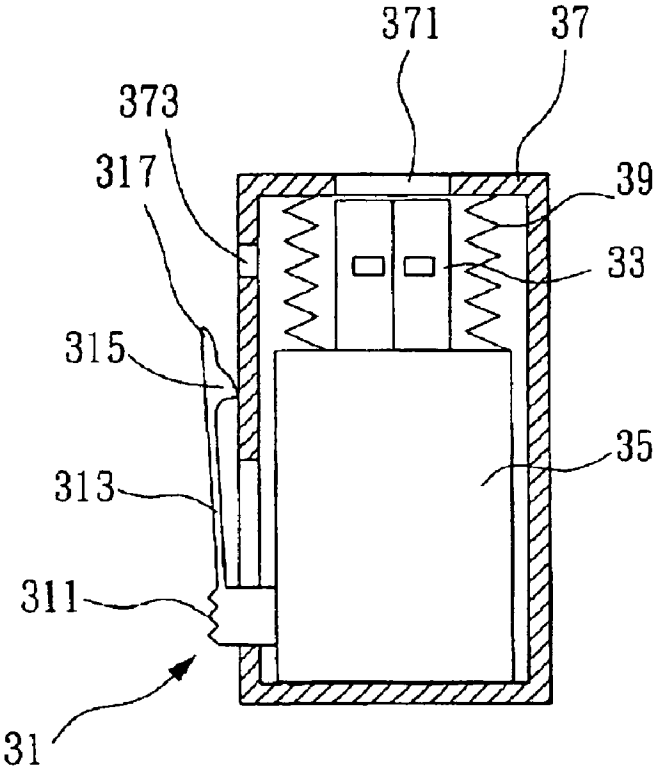
Fig. 3A (Prior Art)

As illustrated, the housing is provided with a hole 412 defined for receiving key chains or strips therein as transportation aids. Differentiated from the prior art flash drive illustrated in FIGS. 2A and 2B, surfaces of a top lid 413 and a bottom lid 414 for covering the data storage apparatus 40 are not slotted. Therefore, the intact surfaces of the top lid 413 and the bottom lid 414 can be reserved for personalization and elaboration on the housing 41. For example, exquisitely-designed logo can be displayed on the intact surfaces of both lids on the manufacturer's site, for the sake of avoiding malicious reproduction.

Figure 5B:
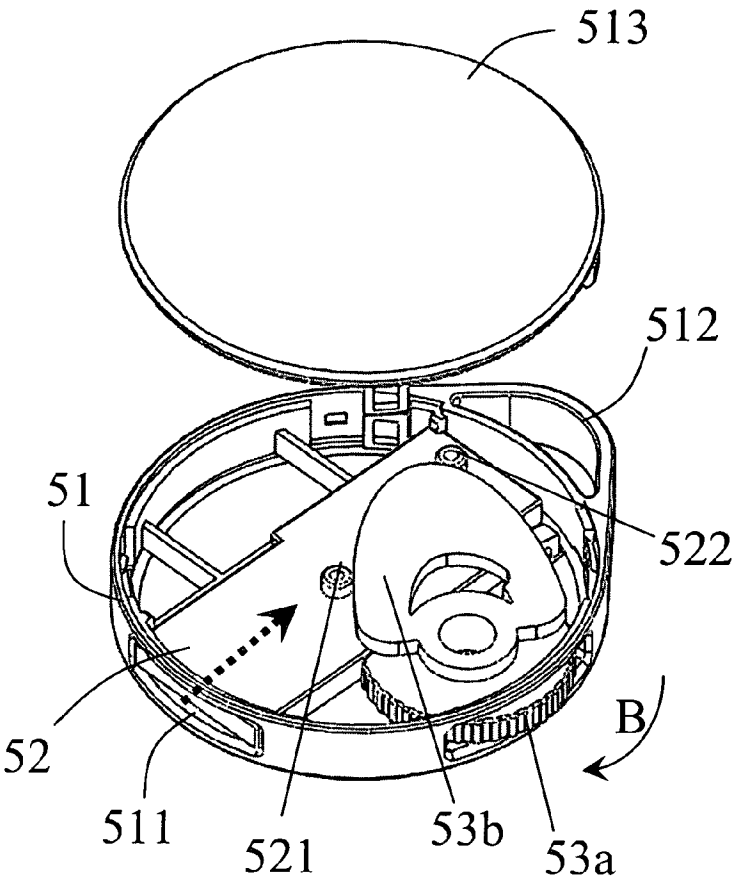
FIGS. 5A-5B illustrate a first embodiment of the data storage apparatus according to the present invention.
Figure 5A:
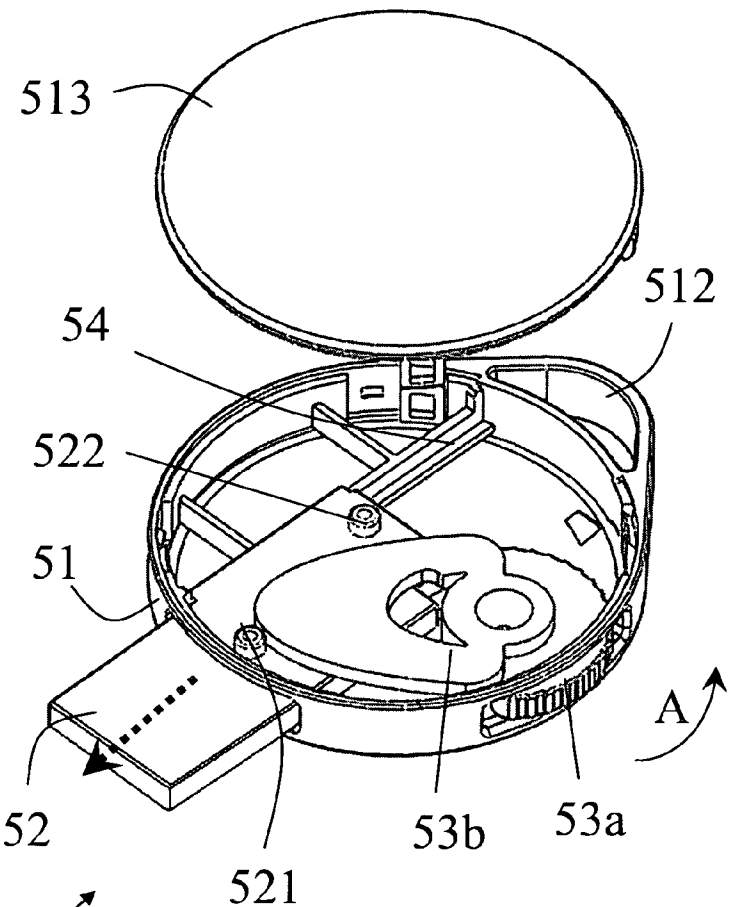

Please refer to FIG. 5A to 5B. They illustrate a first embodiment of the data storage apparatus according to the present invention. As illustrated, a data storage apparatus 50 includes a housing 51, a movable carriage 52, a cam 53*a*, and a guiding track 54 for the movable carriage 52 sliding thereon. The movable carriage 52 is provided for carrying a memory module (not shown) and a USB connector (not shown), which can be replaced with an IEEE-1394 interface connector or an eSATA interface connector to implement this embodiment. The cam 53*a* is pivotally interconnected with a steering unit 53*b*. The cam 53*a* and the steering unit 53*b* work collectively to transmit a generated rotary motion into a linear motion for controlling movement of the movable carriage 52. The steering unit 53*b* is forced toward and thrust a first protrusion 521 disposed on the movable carriage 52 by a rotary motion generated by turning the cam 53*a* in one direction as the arrow A signifies in FIG. 5A, and the movable carriage 52 protrudes out the housing 51 through an opening 511 accordingly, as indicated by the dashed arrow. Likewise, a rotary motion is generated by turning the cam 53*a* in another direction as the arrow B indicates in FIG. 5B, and transmitted to the steering unit 53*b*. Subsequently, the steering unit 53*b* swings to thrust a second protrusion 522 disposed on the movable carriage 52. As devised, the rotary motion contributes to linear movement of the movable carriage 52. The movable carriage 52 is withdrawn back into the housing 51 as the dashed arrow in FIG. 5B illustrated, along a guiding track 54 in a linear motion. Typically, the guiding track 54 is a groove as illustrated in FIG. 5A, yet can be a rail in alternate embodiments. Further, a top lid 513 and a bottom lid (not shown) are provided for covering the housing 51. Alternatively, the housing 51 is further provided with a hole 512 confined for connection to a keychain or a strip for transportation purpose.

Figures 6A, 6B:
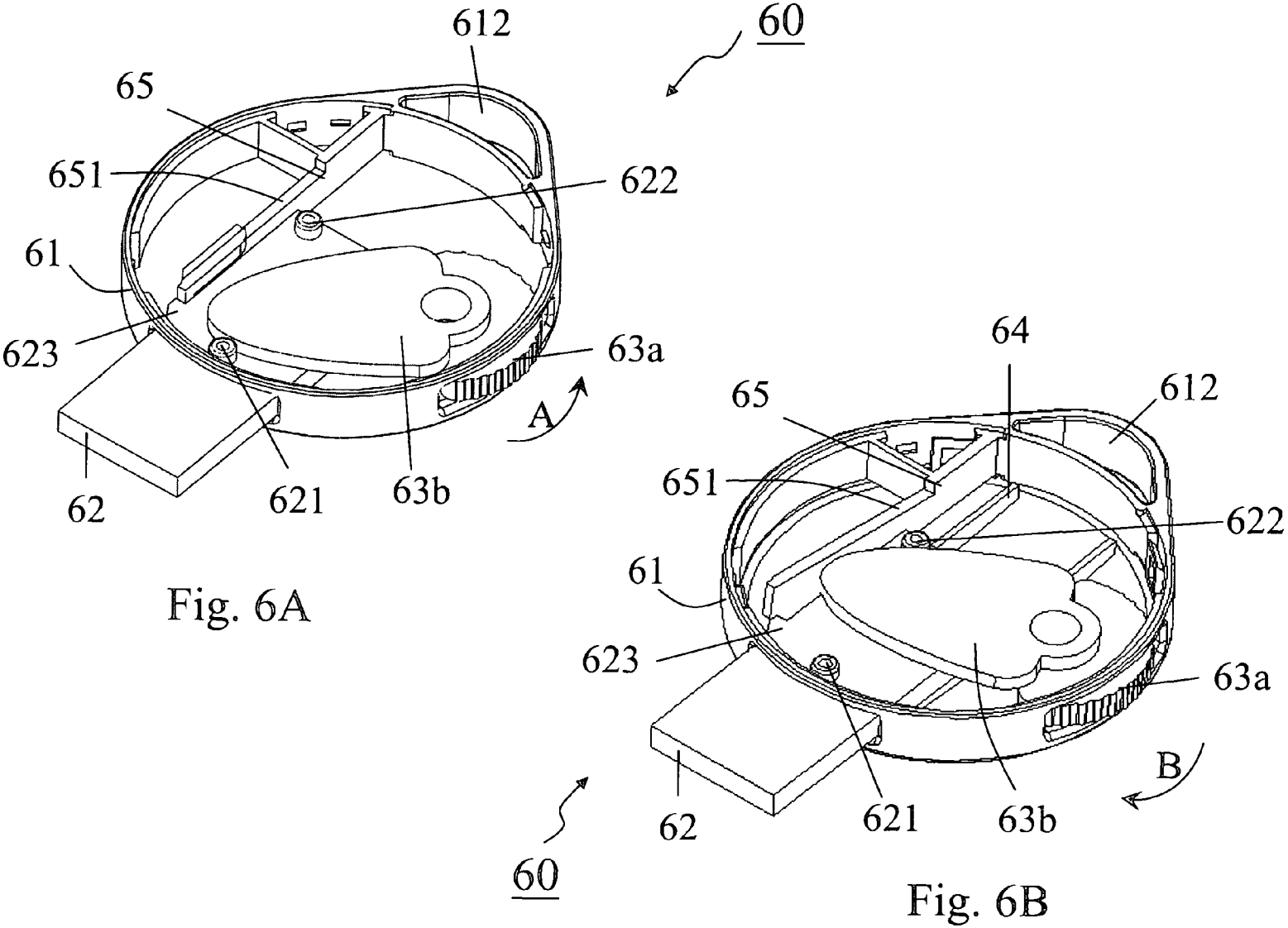
FIGS. 6A-6D illustrate a second embodiment of the data storage apparatus according to the present invention.

Referring now to FIGS. 6A to 6D, they illustrate the second embodiment of implementing the data storage apparatus according to the present invention. The data storage apparatus 60 includes a housing 61, a movable carriage 62 for holding a memory module (not shown) and a USB connector (not shown), a cam 63*a*, and a guiding track 64 for the movable carriage 62 to slide thereon. In alternate embodiments, the USB connector can be replaced with an IEEE-1394 interface connector or an eSATA interface connector to implement the present invention. As shown in FIG. 6A, the data storage apparatus 60, with the movable carriage 62 coupled with the USB connector (not shown) protruded out of the housing 61 through a opening 611, is in the state for plugging into a USB port of a host computer (not shown). The USB connector usually sustains a tremendous force between plugging into and pulling from the USB port of the host computer. A positioning rack 65 is devised for positioning the USB connector during usage with the host computer. The rotary mechanism 63 is turned as the arrow A signifies in FIG. 6A, and a steering unit 63*b* is triggered to press against a first protrusion 621. Resultantly, an extending arm 651 of the positioning rack 65 clips with a flange 623 of the movable carriage 62. Thus, the movable carriage 62 along with the USB connector mounted thereon is positioned.

Figures 6C, 6D:
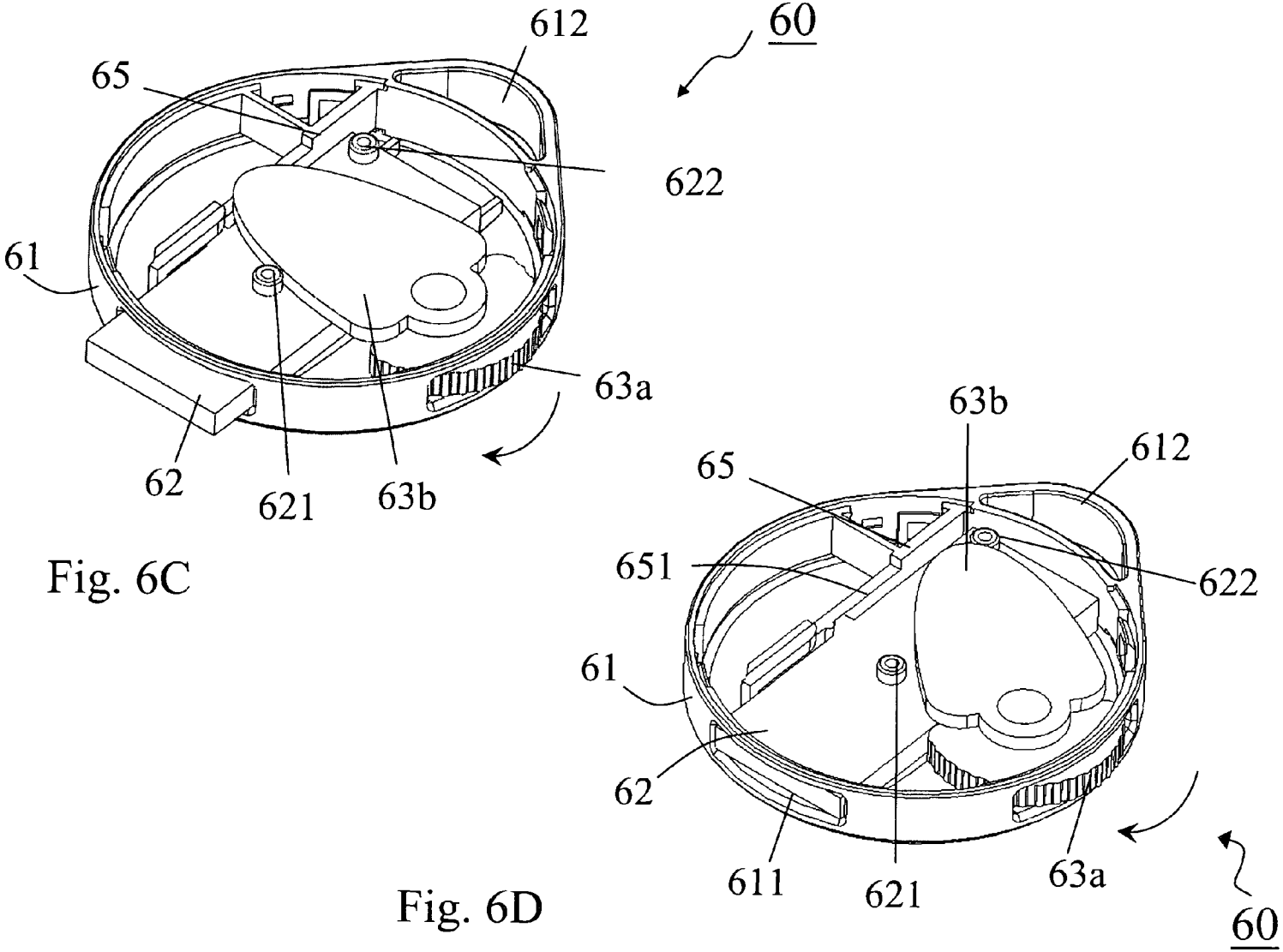

FIGS. 6B to 6C illustrate how to release the movable carriage 62 from being positioned by the positioning rack 65. The cam 63*a* is turned in the direction as the arrow B indicated in FIG. 6B, to generate a rotary motion transmitted onto a steering unit 63*b* to move the movable carriage 62. The steering unit 63*b* is forced toward a second protrusion 622 disposed on the movable carriage 62 by the rotary motion, and front-end of the steering unit 63*b* bumps away the extending arm 651 from clipping with the flange 623. Accordingly, the movable carriage 62 is displaced. As illustrated in FIG. 6C to FIG. 6D, the movable carriage 62 slides back into the housing along the guiding track 64 since the flange 623 is clicked off the extending arm 651. In this matter, the USB connector mounted on the movable carriage 62 becomes hidden and protected in the housing 61.

Typically, the guiding track 64 is a rail, while in various execution of embodiments, a grove can be employed to implement the present invention. As illustrated, the housing 61 is further provided with a hole 612 suitable for connection to a keychain or a strip as a transportation aid. Further, a top lid and a bottom lid (not shown) can be covered onto the housing 61. For better results, the housing 61 can be further equipped with a write-protection switch (not shown) to keep the host computer from writing or modifying data on the data storage apparatus 60.

In conclusion, the present invention discloses a data storage apparatus with means for protecting a USB connector. According to the present invention, a rotary driving mechanism is introduced for controlling movement of the USB connector of the data storage apparatus. Through turning the rotary driving mechanism, a rotary motion is generated and transmitted into a linear motion onto the USB connector. When the rotary driving mechanism is turned backward, the USB connector protrudes out in the other direction, and is in the state for coupling to a host computer. On the other hand, when the rotary mechanism is turned forward, the USB connector is withdrawn back and become hidden in the data storage apparatus. Even though standard double USB ports on a host computer are usually closely spaced, the real-life size data storage apparatus of the present invention is thin enough to be connected to one USB port without blocking the other. In the execution of various embodiments, the USB connector can be replaced with a mini USB connector or other interfaces. The present invention substantively escalates portability of data storage apparatus, and eliminates the prior potential deficiencies. Such ingenious design is generated by ergonomics. By turning the rotary driving mechanism along the curve of user's thumb, the USB connector of the data storage apparatus is protected from unexpected damages as smoothly as it can be.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A data storage apparatus, comprising:

a memory module;

a USB connector connected with the memory module;

a housing for accommodating the memory module, having an opening for allowing the USB connector to pass through the housing;

a movable carriage for holding the memory module and the USB connector; and a rotary driving mechanism for transmitting a rotary motion into a linear motion for moving the USB connector, wherein the movable carriage is provided with a first protrusion and a second protrusion, and is driven by the rotary driving mechanism by pressing against the first protrusion and the second protrusion, thereby moving the USB connector.

2. The data storage apparatus according to claim 1, wherein the rotary driving mechanism comprises a cam and a steering unit pivotally interconnected.

3. The data storage apparatus according to claim 1, wherein the housing comprises a rail for linearly guiding the movable carriage.

4. The data storage apparatus according to claim 1, wherein the housing is provided with a groove for linearly guiding the movable carriage.

5. The data storage apparatus according to claim 1, further comprising a key chain hole on the housing.

6. The data storage apparatus according to claim 1, further comprising a write-protection switch for protecting data stored in the data storage apparatus from being modified.

7. The data storage apparatus according to claim 1, wherein the data storage apparatus comprises a USB PenDrive and a USB flash drive.

8. The data storage apparatus according to claim 1, wherein when the rotary driving mechanism is turned in one direction and pressed against the first protrusion, the USB connector protrudes from the opening, while when the rotary driving mechanism is turned in the other direction, which is opposite to the one direction, and pressed against the second protrusion, the USB connector is withdrawn into the housing.

9. The data storage apparatus according to claim 8, further comprising a positioning rack disposed in the housing for positioning the USB connector when the USB connector protrudes from the opening.

10. The data storage apparatus according to claim 9, wherein the positioning rack comprises an extending arm for clipping with the movable carriage for preventing the USB connector from moving.

11. The data storage apparatus according to claim 10, wherein the USB connector is released when the rotary driving mechanism is turned in the other direction.

12. The data storage apparatus according to claim 10, wherein the extending arm is flexible.

13. A data storage apparatus, comprising:

a memory module;

a host interface connector connected with the memory module;

a housing for accommodating the memory module, having an opening for allowing the host interface connector to pass through the housing;

a movable carriage for holding the memory module and the host interface connector; and a rotary driving mechanism for transmitting a rotary motion into a linear motion for moving the host interface connector, wherein the movable carriage is provided with a first protrusion and a second protrusion, and is driven by the rotary driving mechanism by pressing against the first protrusion and the second protrusion, thereby moving the host interface connector.

14. The data storage apparatus according to claim 13, wherein the host interface connector comprises a USB interface connector, an IEEE-1394 interface connector and an eSATA interface connector.

* * * * *